US007048536B2

(12) United States Patent
Sullivan et al.

(10) Patent No.: US 7,048,536 B2
(45) Date of Patent: May 23, 2006

(54) TEMPERATURE-COMPENSATED COMBUSTION CONTROL

(75) Inventors: John D. Sullivan, Fremont, CA (US); Luis H. Morales, San Jose, CA (US); Robert W. Nickeson, Pleasanton, CA (US)

(73) Assignee: Alzeta Corporation, Santa Clara, CA (US)

( * ) Notice: Subject to any disclaimer, the term of this patent is extended or adjusted under 35 U.S.C. 154(b) by 0 days.

(21) Appl. No.: 10/424,047

(22) Filed: Apr. 25, 2003

(65) Prior Publication Data

US 2004/0214118 A1 Oct. 28, 2004

(51) Int. Cl.
*F23C 9/00* (2006.01)
*F23N 5/00* (2006.01)
*F23N 1/00* (2006.01)

(52) U.S. Cl. ..... 431/12; 431/19; 431/89; 431/90; 431/75

(58) Field of Classification Search ..... 431/18, 431/12, 19, 89, 90, 2, 75, 115, 116, 9
See application file for complete search history.

(56) References Cited

U.S. PATENT DOCUMENTS 3,741,710 A * 6/1973 Nelson ..... 431/90
4,498,863 A * 2/1985 Hanson et al. ..... 431/89
5,486,107 A * 1/1996 Bonne ..... 431/121
5,520,533 A * 5/1996 Vrolijk ..... 431/90
6,533,574 B1 * 3/2003 Pechoux ..... 431/90

FOREIGN PATENT DOCUMENTS

| | | |
|---|---|---|
| JP | 57-175813 | * 10/1982 |
| JP | 60-216120 | * 10/1985 |
| JP | 08-193715 | * 7/1996 |
| JP | 08-261446 | * 10/1996 |
| JP | 10-47654 | * 2/1998 |
| JP | 10-176828 | * 6/1998 |
| WO | WO 91/06809 | * 5/1991 |

* cited by examiner

*Primary Examiner*—Carl D. Price
(74) *Attorney, Agent, or Firm*—DLA Piper Rudnick Gray Cary US LLP

(57) ABSTRACT

The "fuel-air pressure ratio" combustion control system for maintaining a selected fuel-air ratio for a combustion apparatus supplied with air at a substantially constant volumetric rate is improved by means for adjusting the flow rate of fuel in relation to temperature fluctuations of the air. A temperature sensor positioned in the air stream before it mixes with the fuel is connected to a converter which transmits converted temperature signals from the sensor as adjustments of a remote control, secondary valve in the fuel line downstream of a primary valve regulating the flow of fuel. Fuel temperature fluctuations can also be converted into adjustments of the remote control, secondary valve.

7 Claims, 1 Drawing Sheet

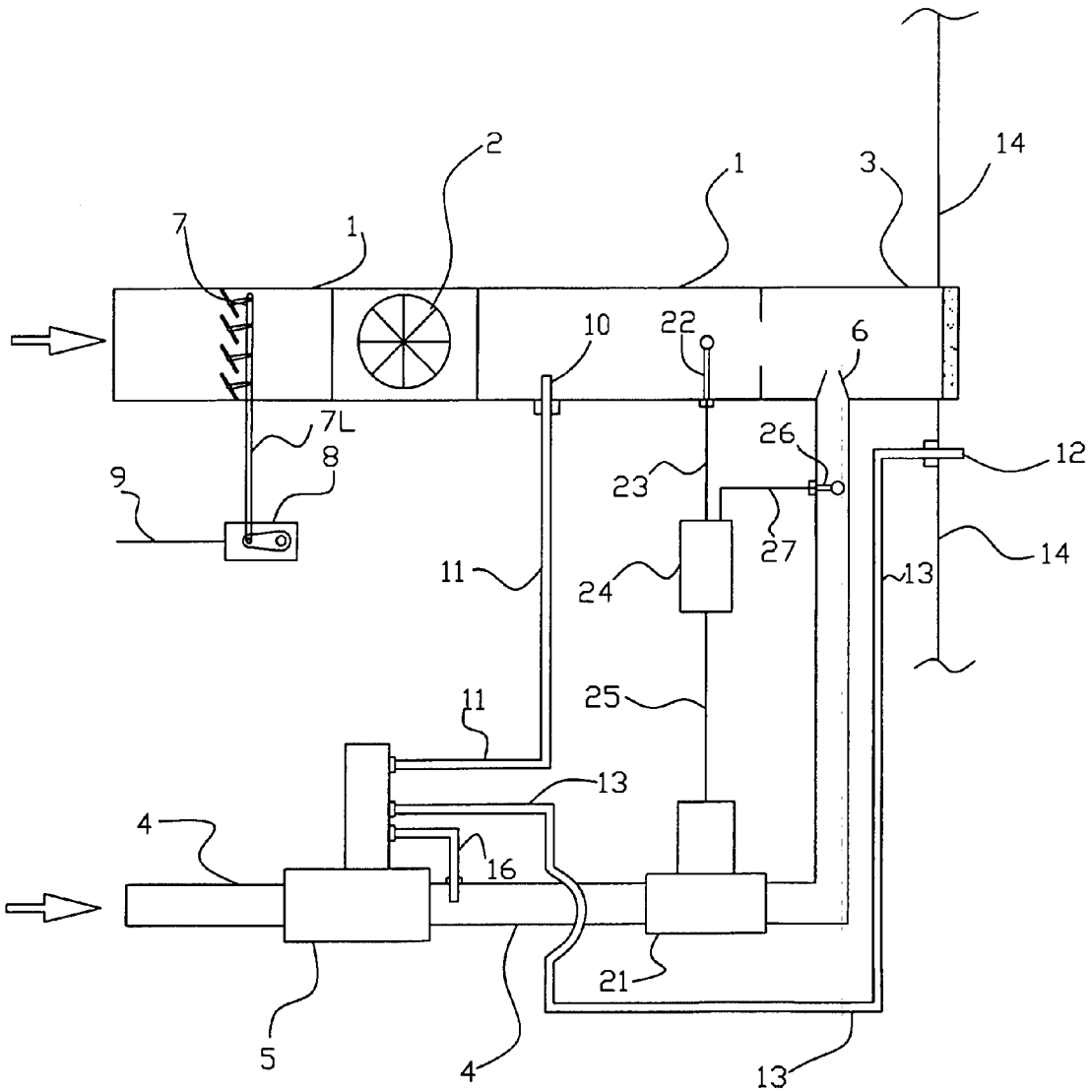
14
3
1
2
1
7
9
7L
8
10
22
6
26
12
14
13
27
23
24
25
13
11
11
16
13
21
4
4
5

TEMPERATURE-COMPENSATED COMBUSTION CONTROL

BACKGROUND OF THE INVENTION

This invention relates to combustion control directed to maintaining fuel efficiency and minimal emissions of air pollutants, especially nitrogen oxides ($NO_x$). More particularly, the invention provides a combustion control system to maintain a selected fuel-air ratio that is improved in that density changes of a reactant, usually air, caused by temperature variations, are compensated for.

A popular combustion control system is based on the use of an electrically operated valve in the fuel supply line which is responsive to variations in the fuel-air pressure ratio. Such a valve is offered by Siemens as the SKP70 pressure regulating electro-hydraulic actuator combined with a Siemens VG series gas valve. This type of fuel-air control is further described in relation to the accompanying drawing which includes the improvement of this invention. This type of control system will hereafter be referred to as the "fuel-air pressure ratio" system for brevity.

A principal object of this invention is to provide an improved combustion control system that in response to temperature changes of the reactants, usually air alone, automatically varies the flow of fuel through a flow regulator to maintain a substantially constant target fuel-air ratio.

Another object is to minimize the use of mechanical linkages in the control system.

These and other features and advantages of the invention will be apparent from the description which follows.

SUMMARY OF THE INVENTION

Basically, the invention incorporates in the "fuel-air pressure ratio" combustion control system means for measuring temperature variations of the air stream and for automatically causing the variations to adjust the flow of fuel to maintain a target fuel air ratio. In an embodiment of the invention, the known combustion control system is improved by the placement of a flow regulator in the fuel supply line downstream of the usual flow regulator. This additional flow regulator is remotely operated in combination with, and in relation to, temperature responsive means that monitor the air stream temperature.

BRIEF DESCRIPTION OF THE DRAWING

To facilitate further description and understanding of the invention, reference will be made to the accompanying drawing which is a schematic representation of the known "fuel-air pressure ratio" combustion control system as improved by the invention.

DESCRIPTION OF THE PREFERRED EMBODIMENT

The drawing shows the "fuel-air pressure ratio" combustion control system as comprising air supply duct 1 with blower 2 supplying burner 3. Fuel supply line 4 with control valve 5 discharges fuel through nozzles 6 into burner 3 to form a uniform fuel-air mixture before exiting burner 3 and undergoing combustion. Air duct 1 has damper 7 which is moved through mechanical linkage by electric motor 8 that is responsive to variations of firing rate signals received through line 9.

Valve 5 is typified by the Siemens combination of a SKP70 pressure regulating electro-hydraulic actuator and a VG series gas valve. Pressure tap 10 in air duct 1 downstream of blower 2 is connected by tubing 11 to the actuator of valve 5 as is a second pressure tap 12 positioned within the combustion zone which is on the right side of partial line 14 that represents a wall enclosing the combustion zone. The pressure signal from tap 10 passed by tubing 11 to the actuator of valve 5 and the pressure signal from tap 12 passed by tubing 13 to the actuator of valve 5 provide a measure of the pressure drop between air in duct 1 and air discharged from burner 3. The pressure of the fuel gas downstream of valve 5 is transmitted by tubing 16 connected to line 4 and the actuator of valve 5.

The combustion control system thus far described is representative of the known "fuel-air pressure ratio" system. The improvement thereof pursuant to the invention comprises the addition of a remote control valve 21 in line 4 downstream of valve 5, a temperature sensor 22 in air duct 1 downstream of blower 2, line 23 for passing temperature signals from sensor 22 to conversion means 24 that controls the operation of valve 21 through line 25. Thus, the addition of components 21 to 25 to the control system has improved the maintenance of the target fuel-air ratio by compensating for temperature-induced density changes of the air stream. When the air temperature drops, valve 21 will adjust for greater flow of fuel to compensate for the flow of denser air. When air temperature rises valve 21 will adjust for lesser flow of fuel. Significant temperature variations of the air stream because of weather conditions and/or recirculated flue gas can seriously change the fuel-air ratio from the target value selected to provide fuel efficiency and minimal ($NO_x$) emissions. That deficiency of the "fuel-air pressure ratio" control system has been eliminated by the invention which modulates the flow of fuel to compensate for air temperature (consequently, density) fluctuations.

The term, "remote control valve", is used herein to mean a valve that is operated electrically or pneumatically or hydraulically. An electrically operated control valve is usually preferred for simplicity.

Of course, combustion systems use excess air to ensure complete combustion of the fuel, and importantly in lean-premixed burners, to lower the combustion temperature to minimize $NO_x$ formation. Excess air is conventionally defined as the amount of air that is in excess of the stoichiometric requirement of the fuel with which it is mixed. Good practice calls for excess air that is 15% or greater. In lean-premixed burners operating at 9 ppm (parts per million on a volumetric basis) or lower $NO_x$ emissions, the excess air level may be 65% or higher. Most of the excess air in the lean-premixed burners serves to lower the combustion temperature and hence its oxygen content acts as an inert like nitrogen to lower combustion temperature.

Inasmuch as flue gas is warmer than air, it is thermally more efficient to recirculate some flue gas in place of some of the excess air in high-excess-air burners. This can be done as long as the oxygen-depleted flue gas is not mixed with air in a proportion that makes the mixture have insufficient oxygen for complete combustion of the fuel. Theoretically, the mass of the fresh air in an air-plus-flue-gas mixture must therefore be sufficient to provide 15% excess oxygen in the fully combusted products in order to be consistent with standard combustion practice.

Once the minimum oxygen requirements for complete combustion are met, any additional mass flow in the air-plus-flue-gas mixture can be inert (no oxygen) and still achieve the desired affect in the low-$NO_x$ burner of lowering the combustion temperature. A typical air-plus-flue-gas stream could therefore be comprised of 100% stoichiometric air, 15% excess air, and flue products that have a mass that is equal to 40% of the total air flow. The total mass flow of this air-plus-flue-gas stream would be equivalent to a "16% excess air" fresh-air-only stream, and would therefore have similar flame-cooling capacity. The benefit of operating with 15% excess air and 40% recirculated flue gas, instead of 61% excess air, is higher thermal efficiency.

Recirculated flue gas is commonly used in combustion systems with firing rates in excess of about 0.5 MBTU/hr (million British Thermal Units per hour). Obviously, the temperature and quantity of recirculated flue gas can cause wide temperature variations of the stream that is mixed with the fuel prior to combustion. Therefore, the invention is particularly valuable in such cases by maintaining substantially constant the fuel-air ratio that was selected for thermal efficiency and low $NO_x$ emissions.

An example of the invention as applied to the fuel-air pressure ratio control system of the drawing for the burner of a watertube boiler fired at a rate of 8.4 MBTU/hr involved the following specific hardware for the control components added to the system pursuant to the invention:

For sensor 22: one-eighth inch diameter by 6 inch long undergrounded K-type Therm-X thermocouple;

For converter 24: Siemens RWF40 Universal Digital Controller that converts K-type thermocouple signals into 4–20 milliamp signals that drive valve 21; and For valve 21: 3 inch diameter NPT Eclipse Butterfly valve with undersized (2⅞ inch diameter) disk, actuated by a Honeywell M7284C Modutrol motor.

The fuel was natural gas (985 BTU per cubic foot) and an air-plus-flue-gas mass flow equivalent to 65% excess air was selected to achieve the desired low $NO_x$ emissions. The actual air-plus-flue gas mixture was allowed to vary between 65% excess air and no flue gas (as the excess air only condition) and 20% excess air and 37% flue gas (as the high flue gas recirculation condition). At 65% excess air or equivalent air-plus-flue-gas mass flow, the Alzeta CSB burner (a porous surface combustion burner) used in this example is known to yield not more than 9 ppm $NO_x$ emissions. The temperature of the air stream (including recirculated flue gas) varied between 50° F. to 200° F. as the fresh combustion air flow was decreased and the flue gas flow was increased. $NO_x$ emissions (corrected to standard 3% stack oxygen) were maintained at a level between 5 and 9 ppm.

Based on experience, without valve 21 and associated components, it is known that the air temperature swing from 50° F. to 200° F. would have caused a 29% change in the mass flow of the air-plus-fuel-gas stream and a 14% change in the mass ratio of fuel to air-plus-flue-gas. Due to the very tight control requirements of ultra-low-$NO_x$ burners, this change in fuel to air-plus-flue-gas mass ratio would have been unacceptably high and would have resulted in either a loss of flame stability or unacceptably high $NO_x$ emissions. With valve 21 and associated components installed, the change in mass flow ratio over the full range of operation was too small to be measured, and was probably less than plus or minus 5%. Good flame stability and sub-9 ppm $NO_x$ emissions were achieved over the full range of operation.

Those skilled in the art will visualize variations and modifications of the invention without departing from the spirit or scope of the invention. For example, if it were desired to compensate also for temperature changes of the fuel, a temperature sensor and a remote control valve would be placed in line 4 downstream of valve 5 and a converter would be connected to receive temperature signals from the sensor and convert the signals into adjustments of the remote control valve. If temperature compensation of only fuel is desired, components 21, 22, 23, 24, 25 can be eliminated. A temperature sensor in fuel line 4 acting with a converter like 24 and a remote control valve in fuel line 4 would cause the fuel flow to decrease as the fuel temperature drops and to increase fuel flow as fuel temperature rises. In short, such fuel flow changes are the opposites of those occurring when air temperature is monitored. While the example of the invention used natural gas and a porous surface combustion burner selected for achieving minimal $NO_x$ emissions, the invention is applicable to any combustion operation using any liquid or gaseous fuel and any type of flame or flameless burner. In view of the frequent use of recirculated flue gas, the mention in the claims of air, that is monitored for temperature variations, means air with or without recirculated flue gas. Accordingly, only such limitations should be imposed on the invention as are set forth in the appended claims.

What is claimed is:

1. In a fuel-air pressure ratio combustion control system for maintaining a selected fuel-air ratio for a combustion apparatus supplied with air at a substantially constant volumetric rate, said control system having a primary valve in the fuel line operated by a pressure regulating electro-hydraulic actuator that has a pressure tap in each of the supplied air, the combustion zone and the fuel line downstream of said primary valve, the improvement of means for adjusting the flow rate of fuel in relation to temperature fluctuations of said air or fuel, which comprises:

a. a remote control, secondary valve in the fuel line downstream of said primary valve regulating the flow of fuel;

b. a temperature sensor positioned to monitor temperature fluctuations of said air or fuel; and c. a converter connected to receive temperature signals from said sensor and connected to said secondary valve to pass thereto converted temperature signals as adjustments of said secondary valve.

2. The combustion control system of claim 1 wherein the remote control, secondary valve is an electrically or pneumatically or hydraulically operated valve.

3. In a combustion process wherein air is supplied at a substantially constant volumetric rate and a fuel-air pressure ratio system for combustion control serves to adjust by means of a primary valve the flow rate of fuel to maintain a selected fuel-air ratio at varying firing rates, said primary valve being operated by a pressure regulating electro-hydraulic actuator that has a pressure tap in each of the supplied air, the combustion zone and the fuel downstream of said primary valve, the improvement of compensating for air temperature fluctuations, which comprises modulating the flow rate of said fuel by a remote control, secondary valve downstream of said primary valve, sensing the temperature of the supplied air, and converting sensed temperature fluctuations into adjustments of said remote control, secondary valve.

4. The improvement of claim 3 wherein the air supplied at a substantially constant volumetric rate contains on a mass basis of at least 15% excess air and as much as 40% recycled flue gas.

5. The improvement of claim 3 wherein the remote control, secondary valve is an electrically or pneumatically or hydraulically operated valve.

6. In a combustion process wherein air is supplied at a substantially constant volumetric rate and a fuel-air pressure ratio system for combustion control serves to adjust by means of a primary valve the flow rate of fuel to maintain a selected fuel-air ratio at varying firing rates, said primary valve being operated by a pressure regulating electro-hydraulic actuator that has a pressure tap in each of the supplied air, the combustion zone and the fuel downstream of said primary valve, the improvement of compensating for fuel temperature fluctuations, which comprises modulating the flow rate of said fuel by a remote control, secondary valve downstream of said primary valve, sensing the temperature of said fuel, and converting sensed temperature fluctuations into adjustments of said remote control, secondary valve.

7. The improvement of claim 6 wherein the remote control, secondary valve is operated electrically or pneumatically or hydraulically.

* * * * *